US008931213B2

(12) United States Patent
Loidolt

(10) Patent No.: US 8,931,213 B2
(45) Date of Patent: Jan. 13, 2015

(54) APPARATUS FOR SLIDING GATES OR SLIDING DOORS

(75) Inventor: Peter Loidolt, Tulwitz (AT)

(73) Assignee: Ceta Elektromechanik GmbH, Tulwitz (AT)

( * ) Notice: Subject to any disclaimer, the term of this patent is extended or adjusted under 35 U.S.C. 154(b) by 579 days.

(21) Appl. No.: 12/373,681

(22) PCT Filed: Jul. 16, 2007

(86) PCT No.: PCT/AT2007/000349
§ 371 (c)(1),
(2), (4) Date: May 8, 2009

(87) PCT Pub. No.: WO2008/006129
PCT Pub. Date: Jan. 17, 2008

(65) Prior Publication Data

US 2009/0307981 A1 Dec. 17, 2009

(30) Foreign Application Priority Data

Jul. 14, 2006 (AT) ..... A 1206/2006
Oct. 3, 2006 (AT) ..... A 1649/2006

(51) Int. Cl.
*E05D 15/06* (2006.01)

(52) U.S. Cl.
CPC ..... *E05D 15/0617* (2013.01); *E05D 15/0686* (2013.01); *E05Y 2201/684* (2013.01); *E05Y 2800/122* (2013.01); *E05Y 2900/402* (2013.01)
USPC ..... 49/404

(58) Field of Classification Search
USPC ..... 49/404, 425, 506, 410, 411, 427; 16/91, 16/99, 100, 105, 106; 4/557, 607
See application file for complete search history.

(56) References Cited

U.S. PATENT DOCUMENTS 2,414,335 A * 1/1947 Schroeder ..... 384/536
3,589,778 A * 6/1971 Olson ..... 384/21

(Continued)

FOREIGN PATENT DOCUMENTS

BE 400225 1/1934
CN 1489666 4/2004

(Continued)

OTHER PUBLICATIONS

Japanese Office action conducted in counterpart Japanese Appln. No. 354390 (May 29, 2012).

(Continued)

*Primary Examiner* — Katherine Mitchell
*Assistant Examiner* — Catherine A Kelly
(74) *Attorney, Agent, or Firm* — Greenblum & Bernstein, P.L.C.

(57) ABSTRACT

The invention relates to a device (1) for slidable devices such as sliding gates or sliding doors. In order to render possible a compact and nevertheless stable construction of the device (1), it is provided according to the invention that the device (1) has a supporting or retaining device (2) and a shorter runner rail (3) as well as a longer runner rail (4), wherein rolling elements (5) and/or sliding elements are provided on the supporting or retaining element (2), via which rolling elements and/or sliding elements the shorter runner rail (3) can be moved, and wherein further rolling elements (6) and/or sliding elements are provided on the shorter runner rail (3) and optionally on the supporting or retaining element (2), via which further rolling elements and/or sliding elements the longer runner rail (4) can be moved.

21 Claims, 5 Drawing Sheets

(56) References Cited

U.S. PATENT DOCUMENTS

| | | | | |
|---|---|---|---|---|
| 3,705,468 | A | 12/1972 | Ashworth | |
| 3,959,849 | A | 6/1976 | Marquardt | |
| 4,336,670 | A | 6/1982 | Brutosky | |
| 5,272,838 | A * | 12/1993 | Gibbs | 49/404 |
| 5,966,879 | A * | 10/1999 | Verbeek et al. | 52/205 |
| 6,511,140 | B2 * | 1/2003 | Corona | 312/334.33 |
| 6,918,157 | B2 | 7/2005 | Koike | |
| 2004/0020613 | A1 | 2/2004 | Koike | |
| 2008/0202032 | A1 * | 8/2008 | Loidolt | 49/413 |

FOREIGN PATENT DOCUMENTS

| | | | | |
|---|---|---|---|---|
| DE | 448 174 | | 8/1927 | |
| DE | 2222761 | | 5/1972 | |
| DE | 8522884 | | 8/1985 | |
| DE | 3537168 | | 4/1987 | |
| DE | 9418079 | | 11/1994 | |
| DE | 29817083 | * | 12/1998 | |
| EP | 94628 | A2 * | 11/1983 | E05D 15/06 |
| JP | 48-49243 | | 7/1973 | |
| JP | 52-146060 | | 11/1977 | |
| JP | 55-77695 | | 5/1980 | |
| JP | 9-217572 | | 8/1997 | |
| JP | 2000-34877 | | 2/2000 | |
| NL | 1001165 | | 8/1995 | |
| WO | 2005093199 | | 10/2005 | |

OTHER PUBLICATIONS

Chinese Office action conducted in counterpart Chinese Appln. No. 200780026774.X (Feb. 29, 2012) (with English language translation).

German Office Action conducted in counterpart German Appln. No. 07 763 746.0/1607 (Aug. 22, 2014) (w/ machine translation).

* cited by examiner

APPARATUS FOR SLIDING GATES OR SLIDING DOORS

CROSS-REFERENCE TO RELATED APPLICATIONS

The present application is a U.S. National Stage of International Patent Application No. PCT/AT2007/000349 filed Jul. 16, 2007, and claims priority of Austrian Patent Application No. A 1206/2006 filed Jul. 14, 2006 and of Austrian Patent Application No. A 1649/2006 filed Oct. 3, 2006.

BACKGROUND OF THE INVENTION

1. Field of the Invention

The invention relates to a device for slidable devices such as sliding gates or sliding doors.

The invention furthermore relates to a displaceable element, in particular a sliding gate or a sliding door, with a device for moving the element.

2. Discussion of Background Information

In the outdoor area, for example, in garden areas or private car parks, sliding gates or sliding doors are increasingly replacing hinged gates or doors of a conventional type. Sliding gates or sliding doors have essential advantages compared to conventional gates or doors: on the one hand sliding gates or sliding doors can be opened to the side so that the space can also be used that would otherwise have to have been kept free as the swiveling range of a gate or of a door. On the other hand, sliding gates or sliding doors can usually be moved on rolling or sliding elements, which is why the actuation thereof is generally possible with comparatively low force, even in the case of heavy gates.

Several requirements are made of sliding gates or sliding doors, in particular those that are used in the outdoor area. A first criterion is that the slidable gates or doors should be embodied as far as possible to be self-supporting, that is without support rollers. Support rollers namely require a smooth and clean substrate. At the same time, the device necessary to move the gate should require the smallest possible space, so that the appearance of the gate per se is disturbed as little as possible. A second criterion is an ease of movement of the gate or of the door during opening, since the lowest possible expenditure of force should be necessary for an opening. In addition, a third criterion is that the gate or the door should be as stable as possible during opening/closing as well as in the extended (or closed) and in the retracted (or opened) state.

Sliding gates or sliding doors for the outdoor area often comprise mainly metal and are therefore heavy. In order nevertheless to be able to construct self-supporting sliding gates or sliding doors, the teaching of WO 2005/093199 A1 can be consulted. According to this document, a device for sliding gates became known, which has a central carrier with fixed rollers and with a runner rail with an S-shaped profile. A gate equipped with track rollers can be moved in the upper part of the runner rail at a speed v by means of a motor. In addition, the runner rail can be moved by means of the same motor at half speed v/2 via the fixed rollers of the carrier. This means that the sliding gate, independent of its position, is always supported in part by the runner rail supported in a displaceable manner, which permits a self-supporting embodiment.

With the variant presented above according to the prior art, however, it is a disadvantage that the rollers attached to the gate and the rollers of the carrier are respectively positioned above one another in one half of the S-shaped runner rail, thus a relatively high substructure is necessary. This means not only that the high esthetic requirements are not met, but also that the gate has an unsatisfactory stability during movement and in the opened or closed state.

SUMMARY OF THE EMBODIMENTS

The invention starts from this point and has the object of disclosing a device of the type mentioned at the outset, which renders possible a more compact construction and on which a gate can be freely carried with high stability.

Another object of the invention is to disclose a displaceable element of the type mentioned at the outset, with which disadvantages of the prior art are eliminated.

This object is attained through a device according to claim 1. Advantageous variants of a device according to the invention are the subject matter of claims 2 through 16.

The further object of the invention is attained through a displaceable element according to claim 17.

The advantages achieved with the invention are to be seen in particular in that a compact and at the same time highly stable substructure for a freely supported gate or a freely supported door is provided. Due to the compact construction method, at the same time esthetic requirements can also be met, since the carrier device requires little space. A compact substructure is achieved in that rolling elements and/or sliding elements are provided on the shorter runner rail. These can be attached at a height of the shorter runner rail, which is dimensioned such that the longer runner rail is easily moveable over the shorter runner rail. The height of a substructure is thus considerably reduced compared to the prior art and the gate also has a lower tendency to tilt. At the same time, due to the movability of the shorter runner rail, it is also ensured that a heavy gate or a heavy door even in the self-supporting state and fully extended is well supported or the gravitational force of the gate (the door) is counteracted. The supporting or retaining element provided, which, for example, can be fixed on the floor side, can be embodied in a solid manner, e.g., of steel and ensures a good dissipation of the weight force of the gate to the ground, which additionally contributes to high stability.

For reasons of stability it is preferred within the scope of the invention that the rolling element and/or sliding elements provided on the shorter runner rail are attached at opposite ends of the runner rail, in order to distribute the load moment generated by the gate or the door over an entire length of the short runner rail.

In a particularly simple and therefore also preferred embodiment variant, the shorter runner rail during movement of the longer runner rail can be moved automatically into a maximum extended or retracted position.

It is also preferred if a profile of the shorter runner rail is embodied essentially closed in cross section. In particular when the device for the gate or the door is attached on the ground side, this prevents the rolling and/or sliding elements from being soiled with dirt, which can impair an ease of movement during displacement. For analogous reasons it is also preferred if a profile of the longer runner rail is likewise embodied to be essentially closed in cross section. A particularly preferred embodiment variant results in this connection when a profile of the longer runner rail at least partially encloses that of the shorter runner rail in cross section, preferably encloses it entirely. In this case, the longer runner rail, which can preferably be present essentially closed, provides the shorter runner rail, regardless of a position, protection from soiling and/or frost. The gate is therefore easily moveable even after longer use or in winter.

A device according to the invention of the type described above can be used to support and move sliding gates or doors and in addition to a compact, space-saving construction, is characterized in that the gates/doors can be attached in an esthetically pleasing and self-supporting manner and at the same time a highly stable substructure is provided for a gate to be supported or a door to be supported, wherein the weight of the gate or of the door loading the longer runner rail is taken over at least in part by the shorter runner rail. The shorter runner rail thereby bears against rolling elements and/or sliding elements of the supporting or retaining element during movement at all times.

When the longer runner rail is fully extended or retracted, a large load can act on the rolling and/or sliding elements due to a long lever, which elements are arranged on the relatively short supporting or retaining element. Above all with heavy door structures with a weight, for example, of more than 300 kilograms, the rolling and/or sliding elements are therefore exposed to an enormous stress. This problem can be eliminated if the rolling elements and/or sliding elements provided on the supporting and/or retaining element are supported in a vertically flexible manner and/or comprise an elastic material and the shorter runner rail can be placed at the supporting or retaining element overcoming a spring force.

It is advantageously achieved thereby that the rolling elements and/or sliding elements that are attached to the supporting or retaining element are vertically displaced when the load is too high, as soon as a spring force is overcome due to an acting dead weight of the structure or of the gate (e.g., in particular in the extended state). The shorter runner rail can then bear against the supporting element and the rolling elements or sliding elements are largely unloaded. This increases a service life of the rolling elements and/or sliding elements and thus ensures an error-free functioning of the device over a long period of time in particular also with heavy gates/doors. It is further advantageous thereby, so that the shorter runner rail can bear against the supporting or retaining element secured against tilting, if supports for the shorter runner rail are provided on the supporting or retaining element. For reasons of stability these are preferably embodied in front-face view approximately with a width of the shorter runner rail. In order to have a most stable possible base or installation for the shorter runner rail, it is favorable thereby for the supports to be arranged approximately in the area of the ends of the supporting or retaining element.

Fundamentally, as soon as it is moveable, the shorter runner rail could be displaced by hand. However, in order to be able to pull out or push in a sliding gate with a hand manipulation, it can be provided that catches are arranged on the longer runner rail, which catches interact with hooks arranged on the shorter runner rail such that the shorter runner rail can be displaced with the longer runner rail as soon as this does not rest on or bear against the supporting or retaining element. In a particularly simple embodiment, the hooks can be hinge-mounted against a spring force and have a stop, through which on contact with the supporting or retaining element an uncoupling from the catch can be triggered.

BRIEF DESCRIPTION OF THE DRAWINGS

Further advantages and effects of the invention result from the following exemplary embodiments. It is self-evident to one skilled in the art that individual features of the following exemplary embodiments—even when they are cited in combination with other features—can be combined with the general concept of the invention explained above.

They show.

DETAILED DESCRIPTION OF THE EMBODIMENTS

Figure 1:
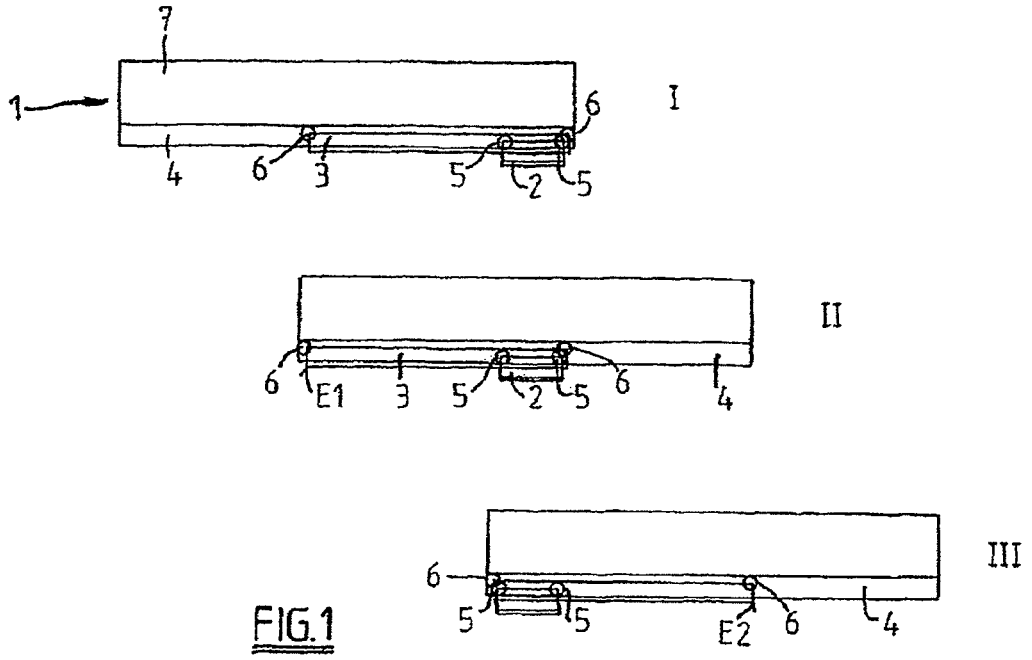
FIG. 1 a device according to the invention with a fixed gate in the opened (I), half-open (II) and closed (III) position.

FIG. 1 shows the inventive concept in more detail based on a schematic diagram. Three positions I, II and III are shown in which a gate 7 is located in the fully retracted (I), half-extended (II) and fully extended (III) state. As can be seen, the device 1 has a short clamping frame or support 2 compared to the length of the gate 7. The clamping frame or support 2 is preferably formed from a solid material, e.g., of steel and has a length of less than 60 cm. The solid embodiment of the support 2 is a prerequisite in order in the case of heavy gates 7 with lengths of more than 3 meters to efficiently dissipate a force into the ground or a foundation and to ensure high stability despite the short embodiment of the support 2 in terms of length.

Fixed pairs of rollers 5 are supported on the head side of the support 2. This is expediently carried out in that the roller pairs 5 have a maximum horizontal distance from one another, which in turn has an effect on a good force dissipation into the ground and consequently a high stability of the device 1 as a whole. A runner rail 3 runs on the pairs of rollers 5, which runner rail in turn is equipped on the end side respectively at positions E1, E2 with two pairs of rollers 6. These pairs of rollers 6 are provided for a further runner rail 4, the length of which exceeds that of the runner rail 3 and which supports a gate 7. As can be seen from the schematic diagram, a vertical spacing between the longer runner rail 4 and the shorter runner rail 3 is small and essentially depends only on the height at which the pairs of rollers 6 are attached. Ideally the pairs of rollers 6 are positioned at a height that just renders possible an easy sliding of the runner rail 4 or of the gate 7 on the shorter runner rail 3. A substructure is thus given that is compact or reduced in height and highly stable.

As can also be seen based on the schematic diagram in FIG. 1, the shorter runner rail 3 is used in particular to absorb a weight force of the gate 7. If the gate is now moved from a position I via a position II into a position III, at the latest upon impingement of the closed longer runner rail 4 on the rollers of the shorter runner rail 3 the same is carried along with it, since it is slidably supported on the rollers 5 of the support 2. Through this carrying along of the shorter runner rail 3 by the longer runner rail 4 it is rendered possible that the gate is also fully supported in the position III by the runner rail or support rail 3. This makes it possible to freely support the gate 7 despite reduced substructure in terms of height.

Figure 2:
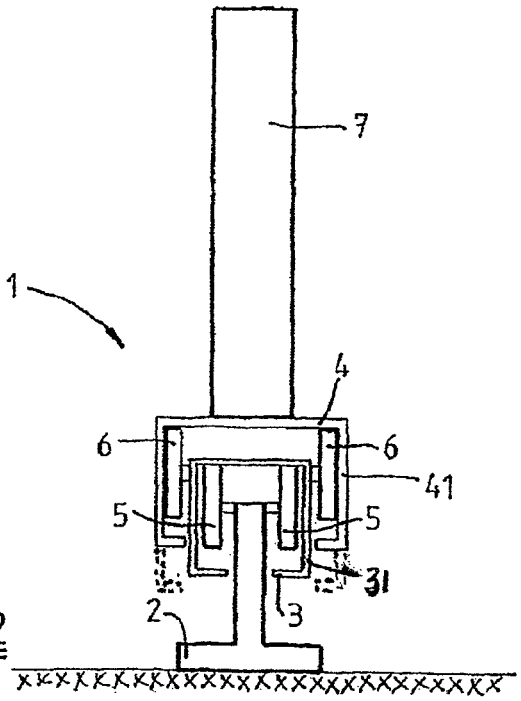
FIG. 2 a device according to the invention in cross section.

FIG. 2 shows a device 1 according to the invention with a mounted gate 7 in more detail in cross section. As can be seen, the device 1 comprises a T-shaped support 2 that on the head side can be attached in the ground or for example on a foundation and is embodied in a solid manner. Pairs of rollers 5 are supported on the support 2, via which roller pairs a runner rail 3 can be displaced. The runner rail 3 is embodied in an essentially closed manner, that means that only one cutout is provided for the support 2, so that an easy movement or rolling is possible. Further pairs of rollers 6 are provided on the runner rail 3, which pairs of rollers in turn accommodate a longer runner rail 4. The runner rail 4 thereby comprises in part, as shown in FIG. 2, the runner rail 3 and is thereby likewise embodied in a closed manner so that the runner rail 4 can roll along the pair of rollers 6 around the runner rail 3. Of course, alternative embodiments are likewise conceivable. For example, the longer runner rail 4 can be embodied in cross section such that its lateral arms 41 extend over the lateral arms 31 of the runner rail 3 (as shown in dashed lines) and in cross section only one cutout for the support 2 is provided.

Figure 3:
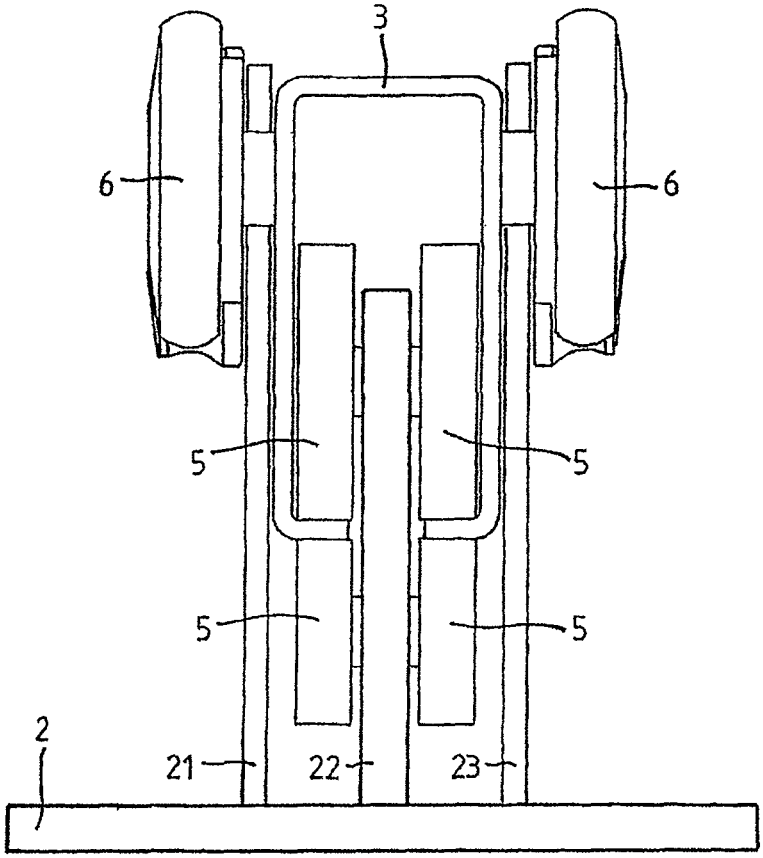
FIG. 3 an embodiment variant of a device according to the invention.

As shown based on FIG. 3, it is not absolutely necessary that all of the pairs of rollers 6 that are provided for moving the runner rail 4 are attached to the shorter runner rail 3. Instead it can also be provided that one of the pairs of rollers 6 is directly supported on the support 2. This provides the advantage, since the support 2 is determined for a load bearing, that essential parts of the acting load moment are absorbed or dissipated via the support 2.

As likewise discernible based on FIG. 3, the support 2 can be formed with perpendicular, parallel plates 21, 22, 23, wherein pairs of rollers 5 are supported in the free spaces formed by them. This helps even further to secure the pairs of rollers 5 or the runner rail 3 against effects of dirt and deposits.

Figure 4:
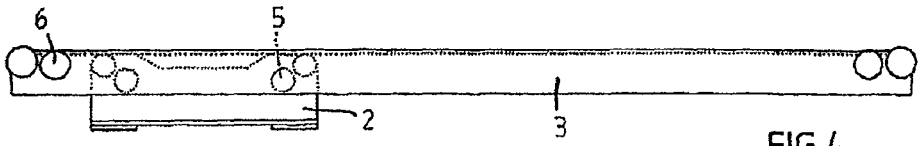
FIG. 4 a device according to the invention in side view.
Figure 5:
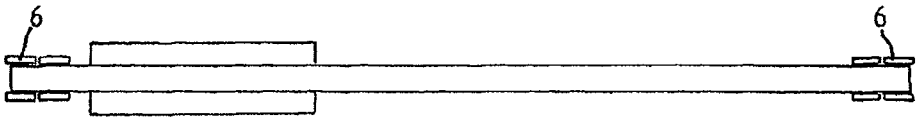
FIG. 5 the device shown in FIG. 4 in plan view.
Figure 6:
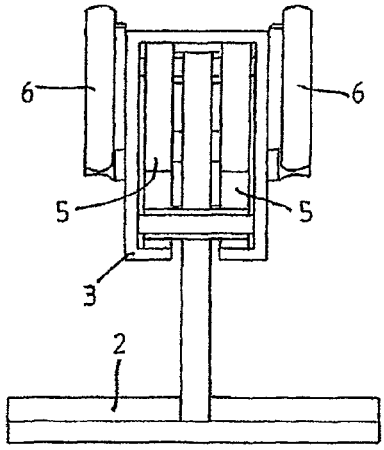
FIG. 6 a device according to FIG. 4 in a front view.

FIG. 4, FIG. 5 and FIG. 6 show another embodiment variant of a device according to the invention. With this variant respectively upper and lower pairs of rollers 5, 6 are provided on the support or retaining element 2 and the shorter runner rail 3. This produces in particular with the variant shown in FIG. 2 the advantage that the runner rails 3, 4 run on the upper as well as the lower pairs or rollers or are held thereby, which ensures a particularly high stability of the device or of the mounted gate 7.

If, as shown in FIG. 1, the gate 7 is located in the fully retracted/extended state (position I or III), with a large weight of the gate 7, very high forces can act on the pairs of rollers 5, since a correspondingly long lever is active due to a length of the gate 7 (in the case of a gate with 200 kilograms, a lever action can lead to a loading of the pairs of rollers 5 of 1500 kilograms).

Figure 7:
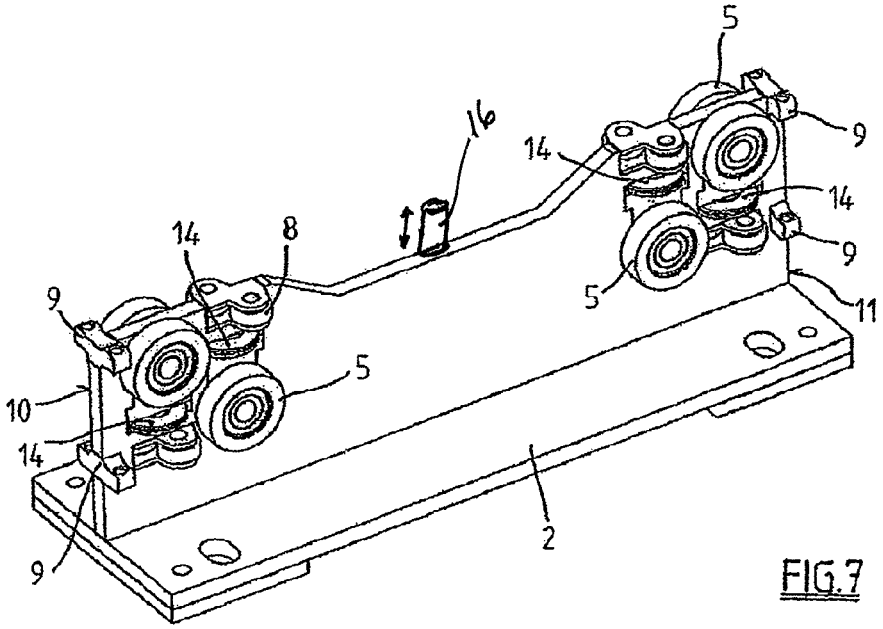
FIG. 7 a supporting or retaining element with flexibly mounted rollers.
Figure 8:
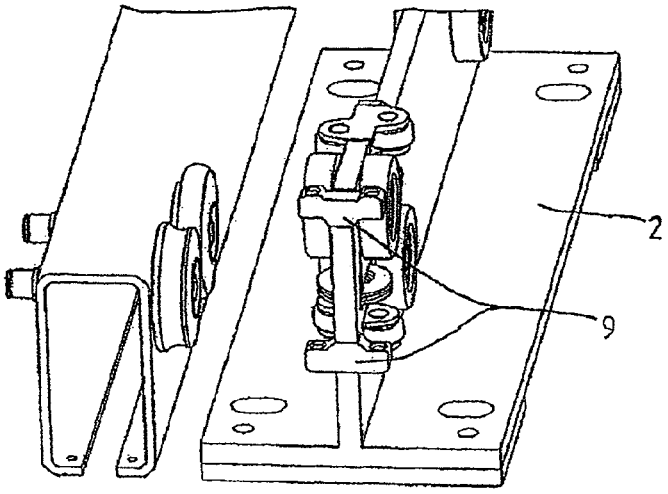
FIG. 8 the supporting or retaining element from FIG. 7 and a part of a runner rail in front view.

This can be avoided when a device 1 according to the invention is used with a supporting or retaining element 2, as shown in FIG. 7 and FIG. 8. With this short solid supporting or retaining element 2, the pairs of rollers 5 are flexibly mounted with the aid of disk springs 14, so that the pairs of rollers 5 with a high load are vertically displaceable. In addition, bases 9 are provided at the ends 10, 11 of the supporting or retaining element 2, against which the shorter runner rail 3 can bear with very high loads, i.e., when the pairs of rollers 5 are compressed against the acting spring forces. The pairs of rollers 5 can also comprise an elastic material, which can promote a bearing of the shorter runner rail 3 against the bases 9.

The mode of operation of a device 1 according to the invention is as follows: in the fully retracted state (see FIG. 1) a high load acts on the rolling elements 5 via the longer runner rail 4 and the gate 7 mounted thereon, which rolling elements are vertically displaced due to this load against the forces of the disk springs 14 until the shorter runner rail 3 bears against or rests on the bases 9. If the gate 7 is now extended and thus the longer runner rail 4 is moved, a load on the rolling elements 5 is reduced, whereby they are moved vertically upwards or downwards by the disk springs 14, so that the shorter runner rail 3 lifts from the bases 9 and can be moved on the rolling elements 5 now rotating. When the longer runner rail 4 approaches the position of the fully extended state, a load in turn is increased, so that the pairs of rollers 5 now are compressed vertically again and the shorter runner rail 3 in turn comes to rest on the bases 9.

A shorter runner rail 3, which interacts with a supporting or retaining element 2, is shown in more detail in FIG. 8 together therewith, wherein only a part of the necessary rollers is mounted on the runner rail 3. As can be seen, bases 9 are attached to the supporting or retaining element 2, the outer contour of which bases is adapted to the inner profile of the runner rail 3, so that the shorter runner rail 3 upon placement comes to rest as far as possible over the full surface laterally as well as horizontally. Thereby an upper or lower base 9 respectively interacts on a side of the support 2 with the diagonally opposite base 9 on the other side of the support 2. The bases 9 have bores in which for example screws or other means can be placed with which a height of the bases 9 can be finely adjusted so that the load at which the runner rail 3 comes to rest can be precisely adjusted in interaction with the disk springs 14.

In addition with the support 2 shown in FIG. 7 or FIG. 8 side rollers 8 are provided, which optionally can also be replaced by sliding elements. The side rollers 8 can be laterally flexibly mounted, for example likewise with disk springs, or comprise an elastic material. An embodiment variant of this type proves to be particularly favorable in order to secure the pairs of rollers 5 against damage or the gate 7 additionally against tilting in the case of attacking lateral forces, e.g., strong wind impact. In this variant preferably furthermore lateral mounting elements are provided analogous to the bases 9.

Figure 9:
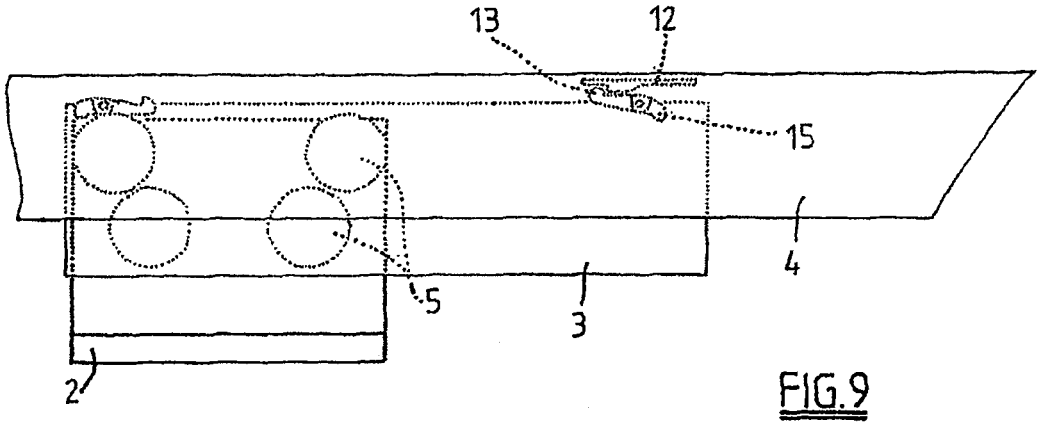
FIG. 9 a device according to the invention with catches for the shorter runner rail.

It is expedient that a mechanism is provided that ensures an automatic movement of the shorter runner rail 3 as soon as the longer runner rail 4 is displaced and the shorter runner rail 3 does not bear against the bases 9. Various mechanisms can be used for this purpose, wherein a particularly simple one is explained based on FIG. 9. A device 1 according to the invention, as was described based on FIG. 8, has a supporting or retaining element 2 with flexibly mounted rolling elements 5. The supporting or retaining element 2 or the rolling elements 5 arranged in pairs bear a shorter runner rail 3, which in turn is provided with pairs of rollers not shown in further detail here, on which a diagrammatically indicated longer runner rail 4 can be moved. In the case shown in FIG. 9, the gate is fully extended. In this state the shorter runner rail 3 as described bears against or rests on the bases 9 of the support 2. If the longer runner rail 4 now during displacement of the gate in FIG. 9 is moved to the left, a load acting on the shorter runner rail 3 and therefore also on the rolling elements 5 in pairs is reduced (smaller lever) so that the shorter runner rail 3 can be moved via the now active rolling elements 5. So that the shorter runner rail 3 is automatically moved before a load is again so high that a movability of the shorter runner rail 3 is no longer given, the longer runner rail 4 has catches 12 that interact with hooks 13 of the shorter runner rail 3. The shorter runner rail 3 is thus automatically carried along and is located in a desired state with respect to its horizontal position when a load is again so high that the rolling elements 5 or the disk springs 14 are compressed and the runner rail 3 comes to rest on the support 2.

As shown in FIG. 9, the hooks 13 are rotatably attached to the shorter runner rail 3 and have an integral stop 15 so that the hooks 13 rotate and release the catches 12 as soon as they impinge on the support 2. So that the hooks 13 after release of the catches 12 are brought into a position active for a carrying along, expediently spring elements are provided, which press the hooks 13 upwards.

As can likewise be seen from FIG. 9, the hooks 13 are arranged approximately in the area of a first end or a second end of the shorter runner rail 3. The catches 12 arranged on the longer runner rail 4 are positioned horizontally such that they engage in the hooks 13 as soon as the shorter runner rail 3 can be moved via the rolling elements 5.

Considerably heavier gates can be supported with a device according to the invention than before. For example, it is possible to move gates with up to several hundred kilograms with the aid of a device according to the invention. The provided springs 14 are thereby preferably designed such that with a high load of, for example, more than 400 kilograms, the shorter runner rail 3 comes to rest on the support 2. A load on the rolling elements 5 is thus low even with the enormous masses given. At the same time, however, the shorter runner rail 3 is used to support the longer runner rail 4 and thus takes over a major part of the load even in the fully extended or fully retracted state of the gate. This load is finally transferred to the supporting or retaining element 2, which is expediently made of a steel in a solid manner and therefore can absorb and dissipate the high loads despite the short construction.

Although not shown, the shorter runner rail 3 does not necessarily have to be embodied in a straight manner, but can also be embodied preferably at least in part in a curved manner. A curvature of the runner rail 3 caused by the load of the gate can thus be compensated, which for example in the area of the supporting or retaining element 2 is only 2 mm, but in the extended state of the gate can lead to a sinking of several centimeters. An embodiment of this type can also be expedient when due to the environment the gate should be horizontal in the retracted state but should be tilted in the extended state.

Alternatively to a curved embodiment of the shorter runner rail 3, it is also possible with a straight embodiment of the shorter runner rail 3 to provide an adjusting means 16, for example, on the support 2 (see FIG. 7), with which adjusting means 16 the shorter runner rail 3 can be slightly curved and supported on the adjustment means 16.

Although a use of a device 1 according to the invention has been described above by way of example for sliding gates, a device 1 of this type can also be used with shelf systems and store systems, porches, covers, mobile bridges, working platforms and formwork platforms, propulsion machines (tunnel construction and mining), extraction and extension devices in mechanical engineering and instrument manufacture, with room dividers and furniture as well as quite generally with devices with which large loads have to be displaced on a short support element with respect to the extension length of the device. In particular an embodiment of the supporting or retaining element 2 according to FIG. 7 has proven to be expedient thereby. The supporting or retaining element can thereby also be embodied in a multiple-part manner, so that a length of the same can be adjusted depending on the use.

The invention claimed is:

1. An apparatus for slidable devices, comprising:

one of a supporting or retaining element;

at least two runner rails, including a shorter runner rail and a longer runner rail, wherein the longer runner rail is longer in a rail running direction than the shorter runner rail;

elements provided on the one of the supporting or retaining element and by which the shorter runner rail is movable upon the one of the supporting or retaining element;

at least one further element attached, with respect to the rail running direction, at opposite ends of the shorter runner rail by which the longer runner rail is movable upon the shorter runner rail; and a mechanism structured and arranged for automatic movement of the shorter runner rail by engagement with the longer runner rail such that the shorter runner rail is displaced with the longer runner rail, wherein the one of the supporting or retaining element is shorter in the rail running direction than the shorter runner rail.

2. The apparatus according to claim 1, wherein, during movement of the longer runner rail, the shorter runner rail is automatically carried along to a maximum one of an extended position or retracted position.

3. The apparatus according to claim 1, wherein a profile of the shorter runner rail is embodied to be essentially closed in a cross section perpendicular to the rail running direction.

4. The apparatus according to claim 1, wherein a profile of the longer runner rail is embodied to be essentially closed in a cross section perpendicular to the rail running direction.

5. The apparatus according to claim 1, wherein, in a plane perpendicular to the rail running direction, a profile of the longer runner rail at least partially encloses a cross-sectional profile of the shorter runner rail.

6. The apparatus according to claim 1, wherein the elements provided on the one of the supporting or retaining element is vertically flexibly mounted and comprises an elastic material.

7. The apparatus according to claim 6, wherein bases are provided for the shorter runner rail on the one of the supporting or retaining element.

8. The apparatus according to claim 7, wherein the bases are embodied with approximately a width of the shorter runner rail.

9. The apparatus according to claim 7, wherein the bases are arranged approximately in an area of the one of the supporting or retaining element.

10. The apparatus according to claim 6, wherein the mechanism comprises catches arranged on the longer runner rail to interact with hooks arranged on the shorter runner rail, whereby the shorter runner rail is displaceable with the longer runner rail as soon as the catches interact with the hooks.

11. The apparatus according to claim 10, wherein the hooks are hinge mounted against a spring force and have a stop through which upon contact with the one of the supporting or retaining element an uncoupling from the catch is achieved.

12. The apparatus according to claim 6, wherein horizontally positioned side rollers or side sliding elements are provided on the one of the supporting or retaining element.

13. The apparatus according to claim 12, wherein the side rollers or side sliding elements at least one of: are horizontally flexibly mounted; and comprise an elastic material.

14. The apparatus according to claim 1, wherein an adjusting element is provided in order to bend the shorter runner rail along the rail running direction.

15. The apparatus according to claim 1, wherein the shorter runner rail is embodied in a curved manner.

16. A displaceable element with a device for moving the element, wherein the device is embodied according to claim 1 and the element is attached to the longer runner rail.

17. The displaceable element according to claim 16, wherein the element is a sliding gate or a sliding door.

18. A method of supporting moving devices on the apparatus for slidable devices according to claim 1, the elements one of: are flexibly mounted at least one of vertically and horizontally or comprise an elastic material, the method comprising:

guiding the longer runner rail to move by the further elements attached at opposite ends of the shorter running rail, and guiding the shorter running rail to move by the elements on over the one of the supporting and retaining element.

19. The apparatus according to claim 5, wherein the profile of the longer runner rail entirely encloses the cross-sectional profile of the shorter runner rail.

20. The apparatus according to claim 1, wherein the one of the supporting or retaining element is positionally fixed.

21. The apparatus according to claim 1, wherein the elements provided on the one of the supporting or retaining element and by which the shorter runner rail is movable comprise at least one of rolling elements or sliding elements, and wherein the further elements provided on the shorter runner rail by which the longer runner rail is movable comprise at least one of further rolling elements or further sliding elements.

* * * * *